US005190470A

United States Patent [19]

Soes et al.

[11] Patent Number: 5,190,470

[45] Date of Patent: Mar. 2, 1993

[54] ELECTRICAL WIRE CONNECTOR AND AN ELECTRICAL TERMINAL THEREFOR

[75] Inventors: Lucas Soes, Rosmalen; Hermanus P. J. Gilissen, Esch, both of Netherlands

[73] Assignee: AMP Incorporated, Harrisburg, Pa.

[21] Appl. No.: 797,494

[22] Filed: Nov. 22, 1991

[30] Foreign Application Priority Data

Dec. 6, 1990 [GB] United Kingdom ..... 9026529

[51] Int. Cl.[5] ..... H01R 4/24

[52] U.S. Cl. ..... 439/417

[58] Field of Search ..... 439/389–425

[56] References Cited

U.S. PATENT DOCUMENTS

| | | | |
|---|---|---|---|
| 3,012,219 | 12/1961 | Levin et al. | 339/98 |
| 4,431,246 | 2/1984 | Vaden | 439/404 |
| 4,435,034 | 3/1984 | Aujla et al. | 439/404 |
| 4,496,207 | 1/1985 | Ensminger | 439/404 |
| 4,533,198 | 8/1985 | Anhalt | 439/404 |
| 4,741,707 | 5/1988 | Mondor, III | 439/417 |

*Primary Examiner*—Joseph H. McGlynn

*Attorney, Agent, or Firm*—Eric J. Groen; Bruce J. Wolstoncroft

[57] ABSTRACT

An electrical wire connector comprises a female insulating housing receiving a male insulating housing. The female housing has anchored therein, a plurality of electrical terminals each having a wire receiving part comprising a pair of arms connected by a bight and defining a wire receiving slot between upper parts of the arms. The arms are resiliently deflectable away from each other as a wire is inserted into the wire receiving slot up to wire contact surfaces between the upper parts of the arms. The male housing has a row of wire receiving passageways each intersecting a slot in the male housing, which slot receives the wire receiving part of a respective terminal when the male housing has been fully inserted into the female housing. Wires previously inserted into the wire receiving passages are forced into the wire receiving slots of the terminals during the insertion of the male housing into the female housing. The parts of each arm are so dimensioned that the wire insertion force is desirably low. Since the arms of the terminals are not plastically deformed by the insertion of the wires, the connector can be used as a switch.

13 Claims, 8 Drawing Sheets

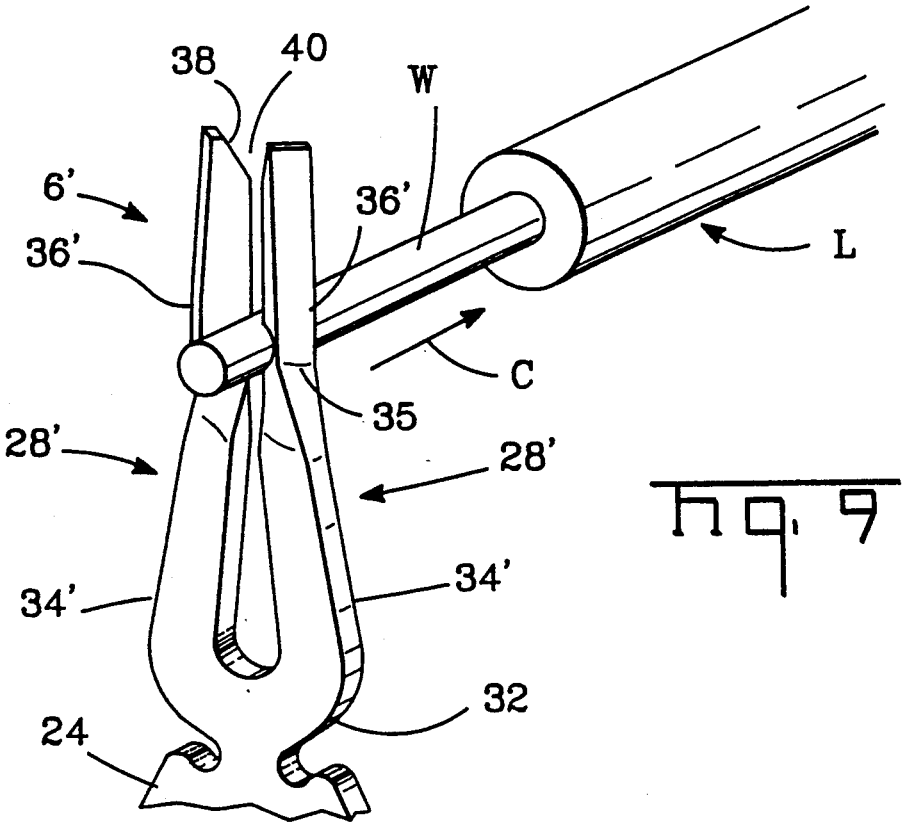
Fig. 9
Fig. 10
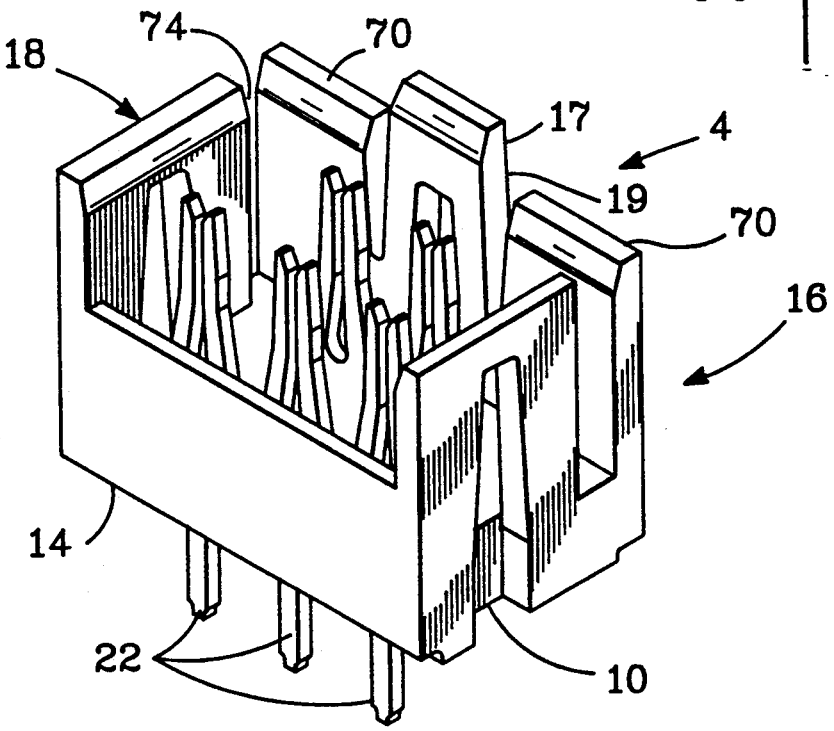

ELECTRICAL WIRE CONNECTOR AND AN ELECTRICAL TERMINAL THEREFOR

BACKGROUND OF THE INVENTION

Field of the Invention

This invention relates to an electrical connector for connecting electrical wires to electrical conductors for example on a printed circuit board.

DESCRIPTION OF THE PRIOR ART

There is disclosed in U.S. Pat. No. 4,435,034, an electrical connector comprising first and second mating insulating housings, the first housing containing a plurality of electrical terminals each comprising a wire receiving part having a pair of arms defining a wire receiving slot, and an anchoring part secured in the first housing, the second housing defining a like plurality of terminal arm receiving slots and a wire receiving passage communicating with each terminal receiving slot and opening into an external face of the second housing, the housings being matable to cause the arms of each terminal to enter a respective one of the arm receiving slots, thereby to force a wire inserted into the wire receiving passage communicating with that arm receiving slot, into the wire receiving slot of said terminal.

In this known connector the arms of each terminal are substantially rigidly connected to the anchoring part of the terminal such that the force needed to drive the metal core of an insulated wire into the wire receiving slot defined by the arms, is undesirably high, especially where the connector comprises several terminals, for example five, and the wire plastically deforms the arms so that if the wire is withdrawn from the wire receiving slot, it cannot effectively be reintroduced thereinto so as to provide an effective galvanic connection between the wire and the terminal.

The connector cannot therefore effectively be used as a switch and is accordingly unsuitable for use in an equipment, for example a domestic television receiver, where the housings may need to be unmated for circuit breaking purposes when the equipment is being serviced and the housings subsequently remated.

SUMMARY OF THE INVENTION

According to one aspect of the present invention, the first housing contains a socket having a plurality of discrete electrical wire receiving terminals positioned in an array in the socket, the second housing being matable with the first housing with the second housing being at least partly insertable in the socket and being movable relative thereto, the second housing having a plurality of discrete terminals receiving slots for enclosing individual wire terminals, the second housing having a plurality of wire receiving passages communicating with the terminal receiving slots, whereby movement of the second housing into the socket, positions the wire in the wire receiving terminal.

The length of the wire receiving slot is preferably such that intermetallics covering the wire as a result of its production process, are cleaned off by the contact engaging surfaces of the arms before the wire reaches the final wire contact surfaces.

Since the arms are in no way plastically deformed as a result of the insertion of the wire, the connector can be used as a switch. To this end, latch means for retaining the housings in their fully mated position may be arranged to be disengageably manually from the exterior of the connector in order to facilitate servicing operations when the connector is in situ.

The arms of each terminal are, according to an embodiment, resiliently torsionable with respect to the anchoring part of the terminal, the terminal arm receiving slot of the second housing having an abutment for limiting the torsionable movement of the second part of each arm upon a wire between the final wire contact surfaces of said second part being accidentally tensioned; whereby corners of the second parts of the arms of the terminal are driven against the wire, and held thereagainst until the arms resile to their initial angular positions upon the tension on the wire ceasing. To this end, the second parts of the arms are preferably of substantially square cross section.

According to another aspect of the invention, a wire receiving electrical terminal which has been stamped from a single piece of sheet metal stock, the terminal comprising a body part to which is connected a pair of arms extending in the same direction and cooperating to define a wire receiving slot having a wire receiving mouth opening in a direction away from the body part, is characterized in that each arm consists of a first part connected to the body part by way of a bight of the terminal material and a second part remote from the bight, the first parts of the arms converging towards each other in a direction away from the bight upon to their junctions with the second parts, the second parts of the arms having opposed parallel, rectilinear wire engaging surfaces extending between said junctions, and the wire receiving mouths terminating in final wire contact surfaces adjacent to said junctions; and in that the length of each arm as measured between the wire receiving mouth and the bight, greatly exceeds the length of each arm as measured between the bight and the final wire contact surfaces, whereby the arms are resiliently deflectable away from each other with a soft spring action by a wire inserted between said wire engaging surfaces.

BRIEF DESCRIPTION OF THE DRAWINGS

FIG. 9 is an enlarged isometric view similar to that of FIG. 7 but showing a terminal according to another embodiment and further illustrating that aspect of the operation of the connector, which is illustrated in FIG. 3;

FIG. 10 is an isometric view of the female housing;

DETAILED DESCRIPTION OF THE PREFERRED EMBODIMENT

An electrical wire connector 2 for making electrical connection to the stripped end portions of insulated electrical leads will now be described in outline with particular reference to FIGS. 1 to 9. The connector 2 comprises a one piece molded female insulating housing 4, having wire receiving electrical terminals 6 secured therein, and a one piece molded male insulating housing 8 for mating with the housing 4.

Figure 2:
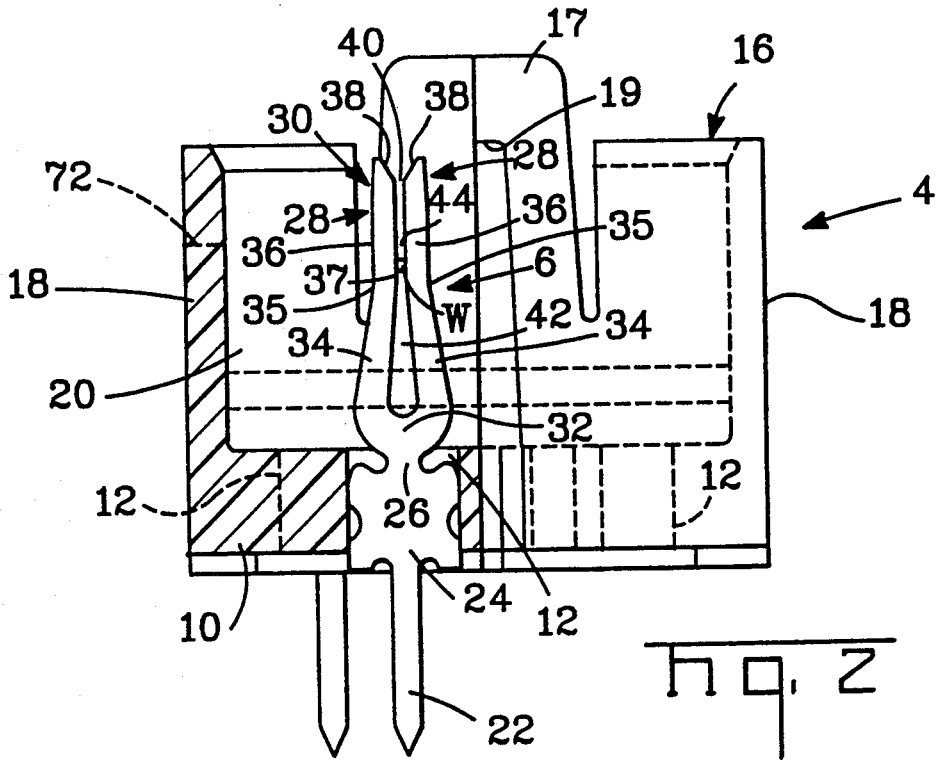
FIG. 2 is a front view of the female housing shown partly in section and with parts omitted.

The female housing 4 comprises a base 10 having through, terminal receiving slots 12 therein front and rear side walls, 14 and 16, respectively, and opposite end walls 18, upstanding from the base 10. The walls 14, 16 and 18 cooperate with the base 10 to define an elongate (as seen in FIG. 2) socket 20. The rear side wall 16 comprises an upstanding resilient latch arm 17 having a latching shoulder 19 as best seen in FIG. 10.

Each terminal 6, which has been stamped and formed from a single piece of sheet metal stock is uniplanar and is of rectangular cross section. Each terminal 6 comprises a pin 22, extending from one side of a substantially square anchoring part 24 from the opposite side of which anchoring part projects a neck 26 supporting a slotted, resilient wire receiving part 30. The part 30 comprises a bight 32 connecting a pair of arms 28, lower parts 34 of which converge towards each other in a direction away from the bight 32 and which, at their position of closest convergence merge at junctions 35 with upper, parallel parts 36 of the arms 28 terminating in chamfered surfaces 38 defining a wire guiding mouth 40. Inner faces of the arms 28, cooperate to define a slot having a part 42 tapering away from the neck 26 and adjoining a narrow rectilinear wire receiving part 44 of the slot. The opposite planar inner faces of the parts 36 of the arms 28 cooperate to provide final wire contact surfaces 37 immediately adjacent to the parts 34 of the arms 28. Each arm 38 has a lever length 11 between its chamfered surface 38 and the bottom of the bight 32, the length 12 between the contact surfaces 37 and the bottom of the bight 32 being greatly shorter than the length 11 as will be apparent from FIG. 6. The arms 28 are capable of resilient torsional movement about their junctions with the bight 32. The ratio of the lengths 11 and 12 is approximately 4:2.5.

Figure 4:
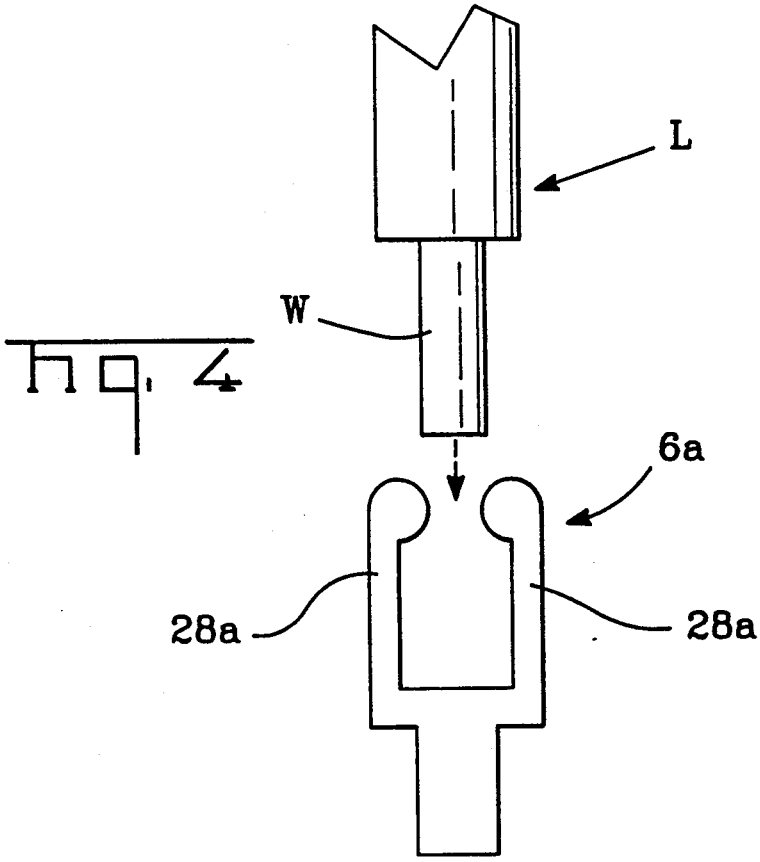
FIG. 4 is an isometric view of a conventional bare wire receiving terminal.
Figure 5:
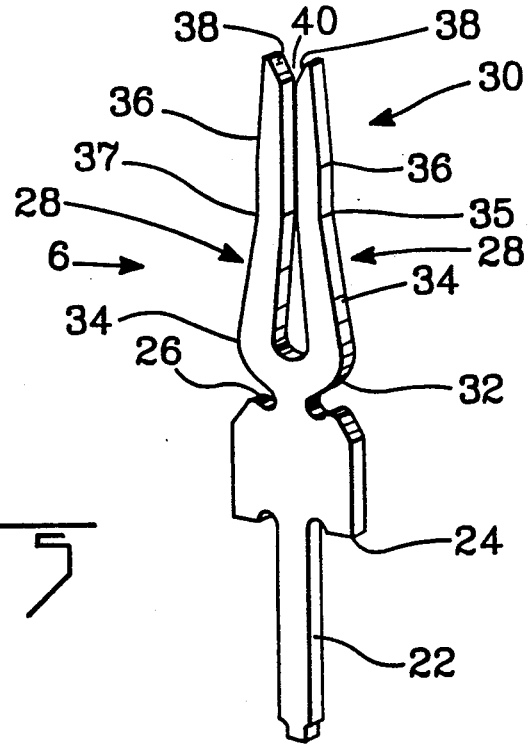
FIG. 5 is an isometric view of one of the terminals of the female housing.
Figure 6:
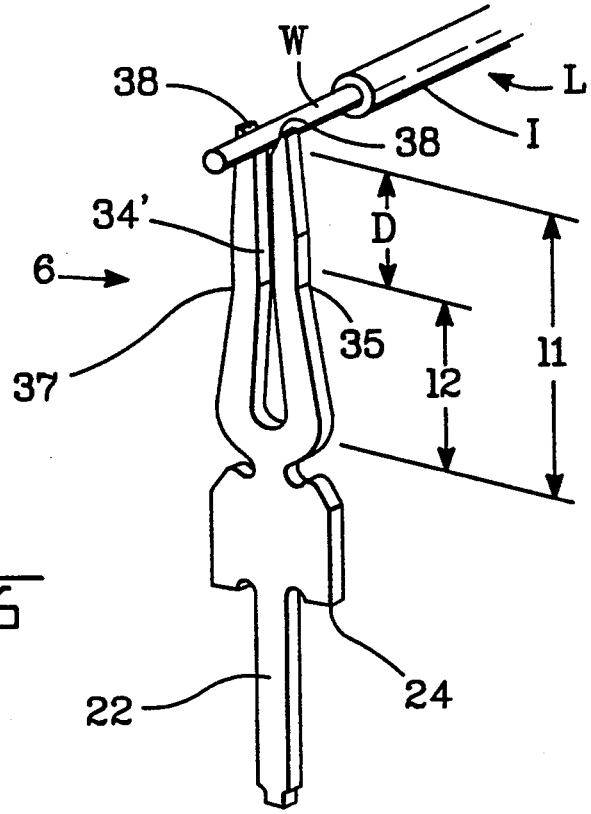
FIGS. 6 and 7 are isometric views illustrating successive stages in the insertion of a stripped wire end portion into the terminal of FIG. 5.

In contradistinction, in a conventional slotted, wire receiving terminal 6*a* shown in FIG. 4, the arms 28*a* are bowed towards each other from the wire receiving mouth 40*a* and thereafter extend parallel to each other up to the anchoring part 24*a* of the terminal.

Figure 1:
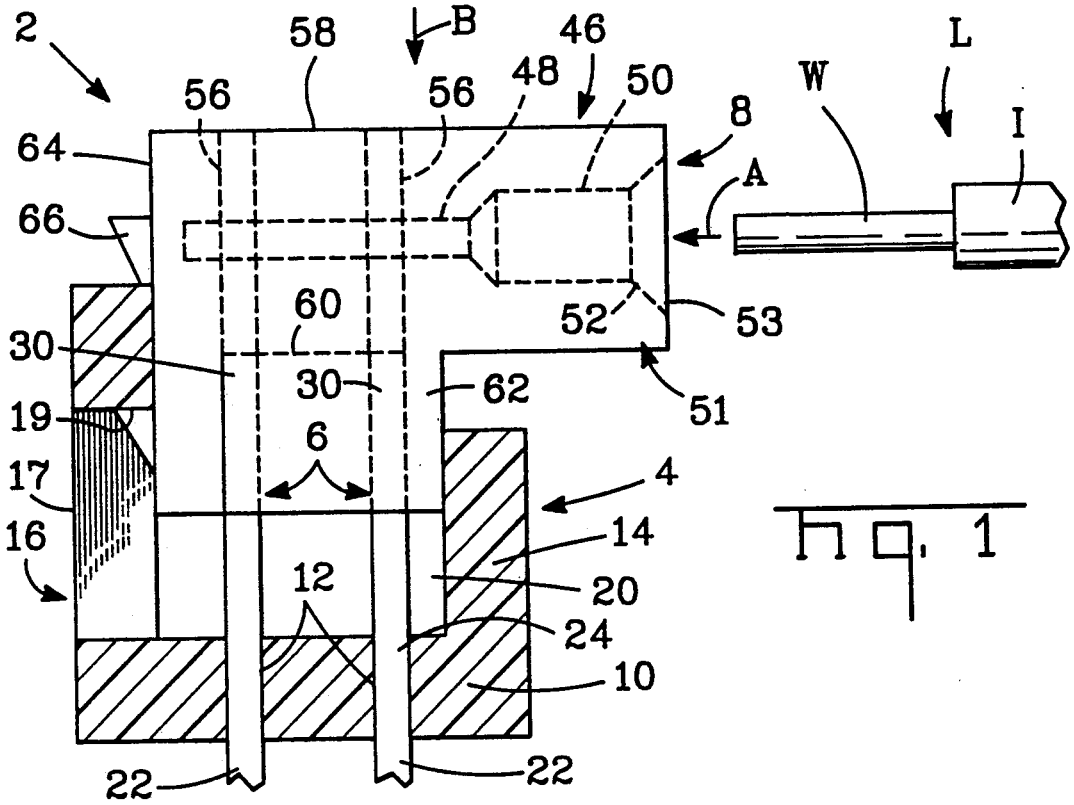
FIG. 1 is a diagrammatic side view shown partly in section, of an electrical wire connector comprising a female housing containing a plurality of wire receiving electrical terminals according to one embodiment, and a male housing for mating with the female housing and for receiving stripped end portions of insulated electrical leads.
Figure 3:
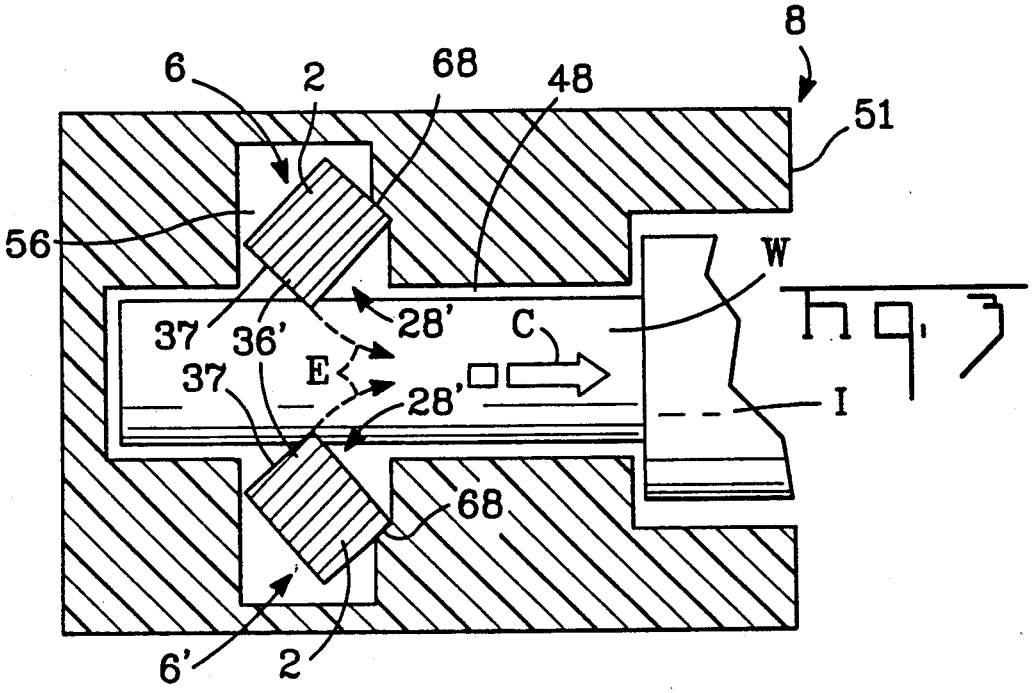
FIG. 3 is a diagrammatic sectional view of the male housing illustrating an aspect of the operation of the connector where the terminals thereof are according to an embodiment of FIG. 9.
Figure 11:
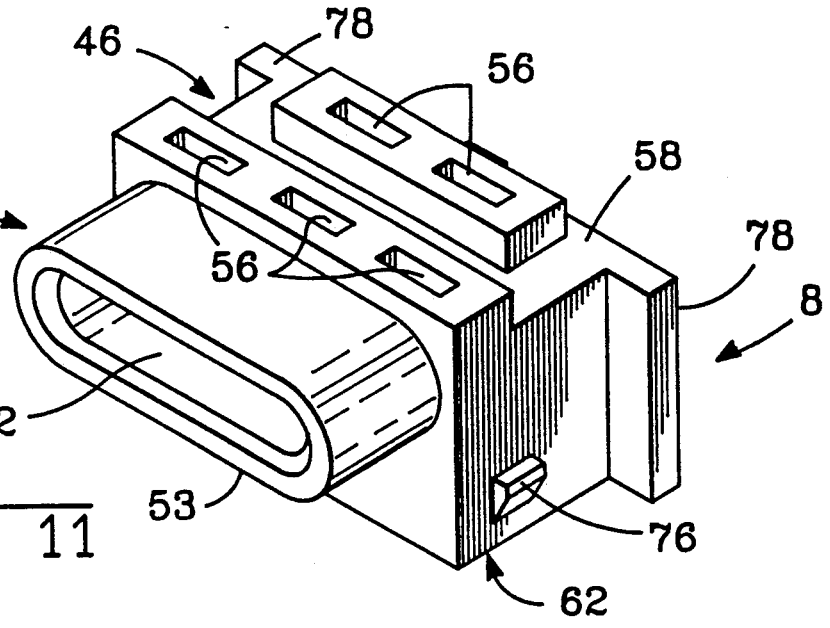
FIG. 11 is an isometric view of the male housing.
Figure 13:
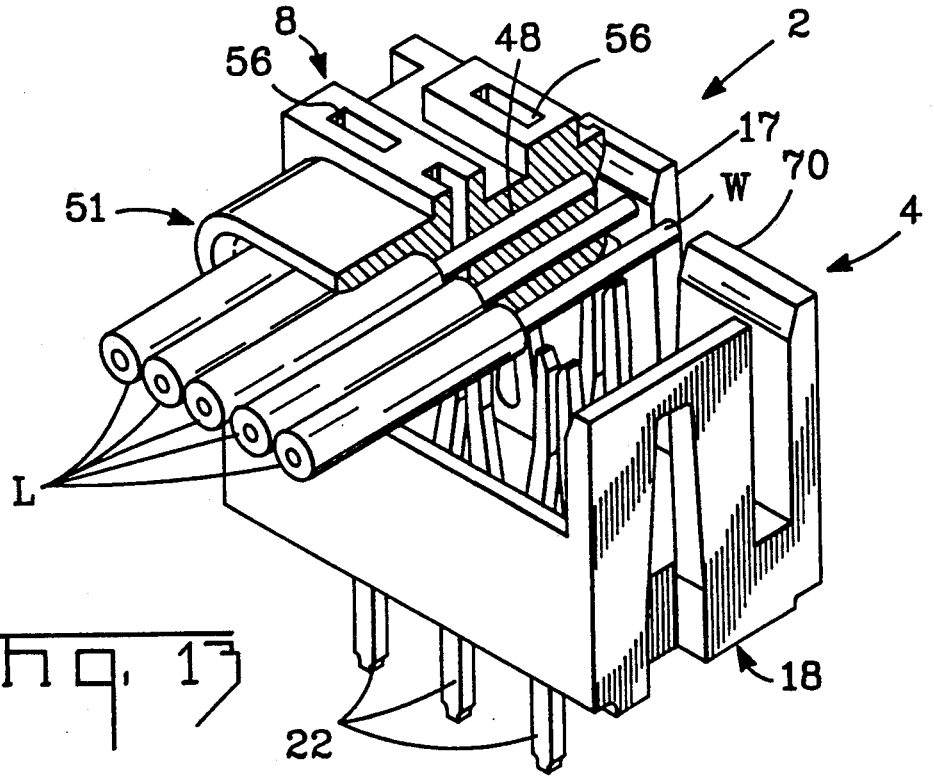
FIG. 13 is a similar view to that of FIG. 12, shown partly in section and showing the lead end portions inserted into the male housing.

As shown in FIG. 1, the male housing 8 comprises an elongate (as best seen in FIG. 11) block 46 having a row of five wire receiving passages 48 (only one of which is shown in FIG. 1) extending in parallel relationship (FIGS. 13 and 14) from a transverse wire receiving channel 50 defined by a hood 51 projecting forwardly from the block 46 and having an enlarged mouth 52 opening into a forward face 53 of the hood 51. There intersects each of the passages 48, a respective one of five terminal arm receiving slots 56 extending perpendicularly to the passages 48 and each opening both into a top face 58 of the block 46 and a bottom face 60 thereof. The block 46 has on a rear face 64 thereof, opposite to the hood 51, a latch member 66 resting on the top of the latch arm 17 (as best seen in FIG. 13) for subsequent latching under the latching shoulder 19 of the latch arm 17 of the female housing 4. As shown in FIG. 3, each slot 56 has therein a pair of abutment shoulders 68, one shoulder 68 being located on each side of the respective passage 48 with which the slot 56 communicates the shoulders 68 being provided where the terminals are according to the embodiment of FIG. 9. A hollow plug 62 depends from the block 46.

In use of the connector 2, the male housing 8 is located in the female housing 4 in an initial position shown in FIG. 1 with the hollow plug 62 of the housing 8 partially inserted into the socket 20 of the housing 4.

The end portions of five wires W of insulated leads L (only one of which is shown in FIG. 1) are stripped of their insulation I for termination by means of the connector 2. Each wire W is inserted into a respective one of the passages 48 in the direction of the arrow A in FIG. 1 by way of the mouth 52 of the hood 51 so that the stripped portion of each wire W is fully received in the passage 48, the end portion of the insulation I of the wire being received in the mouth 52 of the hood 51. The housing 8 is then depressed in the direction of the arrow B in FIG. 1, so that the latch member 66 after resiliently displacing the latch arm 17 snaps under the latching shoulder 19 at which time the plug 62 is fully inserted into the socket 20.

Figure 7:
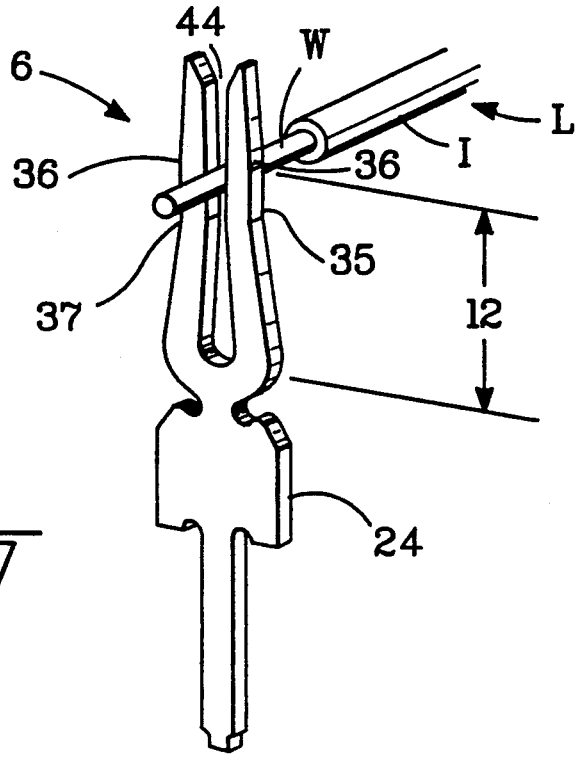
Figure 8:
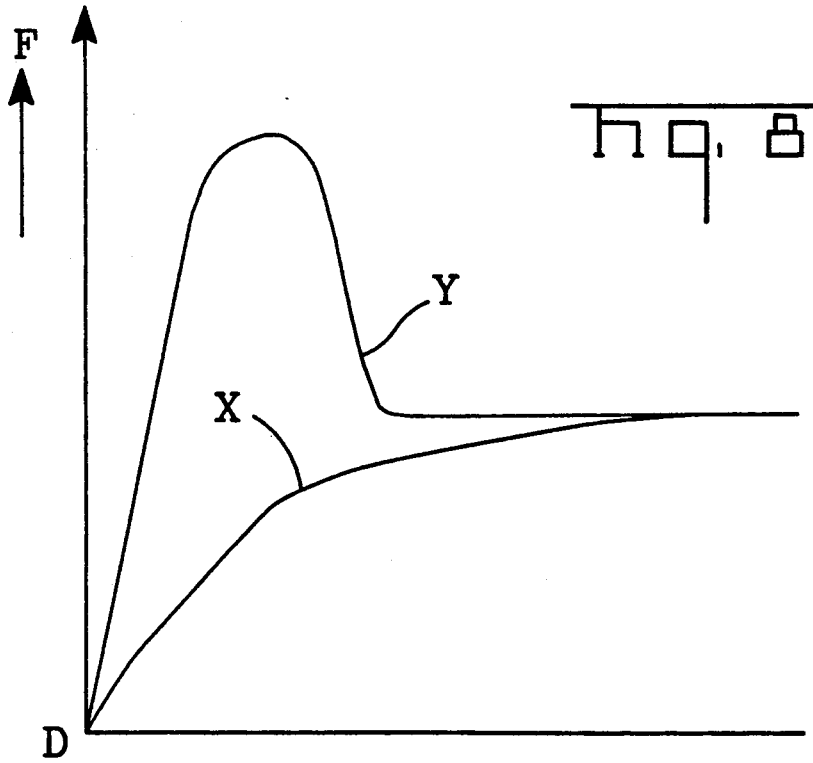
FIG. 8 is a graph illustrating the force exerted by the terminal shown in FIG. 4 and a terminal of the connector against a wire inserted thereinto, plotted against the depth of insertion of the wire into the terminal.

During the insertion of the plug 62, the arms 28 of each terminal 6 enter a respective slot 56 of the housing 8, so that, initially, the wire W in its passage 48 is forced into the rectilinear wire receiving part 44 of the slot of the terminal 6, guided by the chamfered surfaces 38 thereof. As the plug 62 is pushed home into the socket 20, the wire W is forced down between the parts 36 of the arms 28 of the respective terminal 6 until, as shown in FIG. 7, wire W reaches the final wire contact surfaces 37, at which time the plug 62 bottoms on the base 10 of the socket 20 so that the wire W is retained in its final position between the contact surfaces 37 of the arms 28. Each wire W is thereby securely electrically connected to a respective one of the terminals 6. In the graph of FIG. 8, the ordinate represents the contact force F exerted by the arms 28 against the inserted wire W and the abscissa represents the insertion depth D of the wire W between the arms 28. The curve X indicates the wire insertion characteristic of a terminal 6, whereas the curve Y indicates the wire insertion characteristic of the conventional bare wire receiving terminal 6*a* shown in FIG. 4. By virtue of the long lever length 11 and the shorter length 12 referred to above, and thus the soft spring characteristic of the parts 30 of the terminals 6, the curve X rises gradually and does not peak so that the force needed to insert the housing 8 fully into the housing 4 is desirably low, which is of considerable advantage given that five wires W need to be inserted simultaneously into respective terminals 6. In contradistinction to the curve X, the curve Y rises initially very steeply as the wire is forced down between the arms 28*a*.

In the terminal 6' shown in FIG. 9, the arms 28' have been pretorsioned during manufacture of the terminal, about their parts 34' so that their parts 36' are angled with respect to each other. If a lead L is accidentally pulled in the direction of the arrow C in FIGS. 3 and 9, the electrical connection between the wire W and the arms 28' will still be maintained, since, as will appear from FIGS. 3 and 9, arms 28' will be torsioned resiliently about their junctions with the bight 32 as shown in FIG. 9, whereby the parts 36' of the arms 28' will be swung about their longitudinal axes Z as indicated by the arrows E in FIG. 3, so as to engage against the shoulders 68 in the respective passage 48, whereby corners of the parts 36' of the arms 28' of the terminals 6 are driven against the wire W. Upon the tension on the wire W being released, the parts 36' will be returned to their initial positions by virtue of the natural resilience of the arms 28'.

The connector 2 will now be further described with particular reference to FIGS. 10 to 15. As best seen in FIG. 10, the rear side wall 16 of the housing 4 comprises two end portions 70 between which the latch arm 17 upstands beyond the end portions 70. The latching shoulder 19 is defined by the upper end of a vertical slot in the arm 17. Each side wall 18 is in the form of a further latch arm, having a central vertical slot, the upper end of which provides a latching shoulder 72. The five terminals 6 are arranged in an array comprising a front row of three terminals 6 and a rear row of two terminals 6. Each side wall 18 is separated from the adjacent rear wall portion 70 by a vertical keyway 74, the bottom of which is provided by the base 10 of the housing 4.

As shown in FIG. 11, there projects from each end of the plug 62 of the housing 8, a latch member 76 (only one of which is shown) and rearwardly of the latch member 76 projects a vertical key 78 extending over the full height of the block 46 and the plug 62. The slots 56 are arranged in the same array as the terminals 6, namely an array comprising a front row of three slots 56 and rear row of two slots 56. The housing 8 is of substantially the same length as the distance between the side walls 18 of the housing 4, that is to say of substantially the same length as the socket 20.

Figure 12:
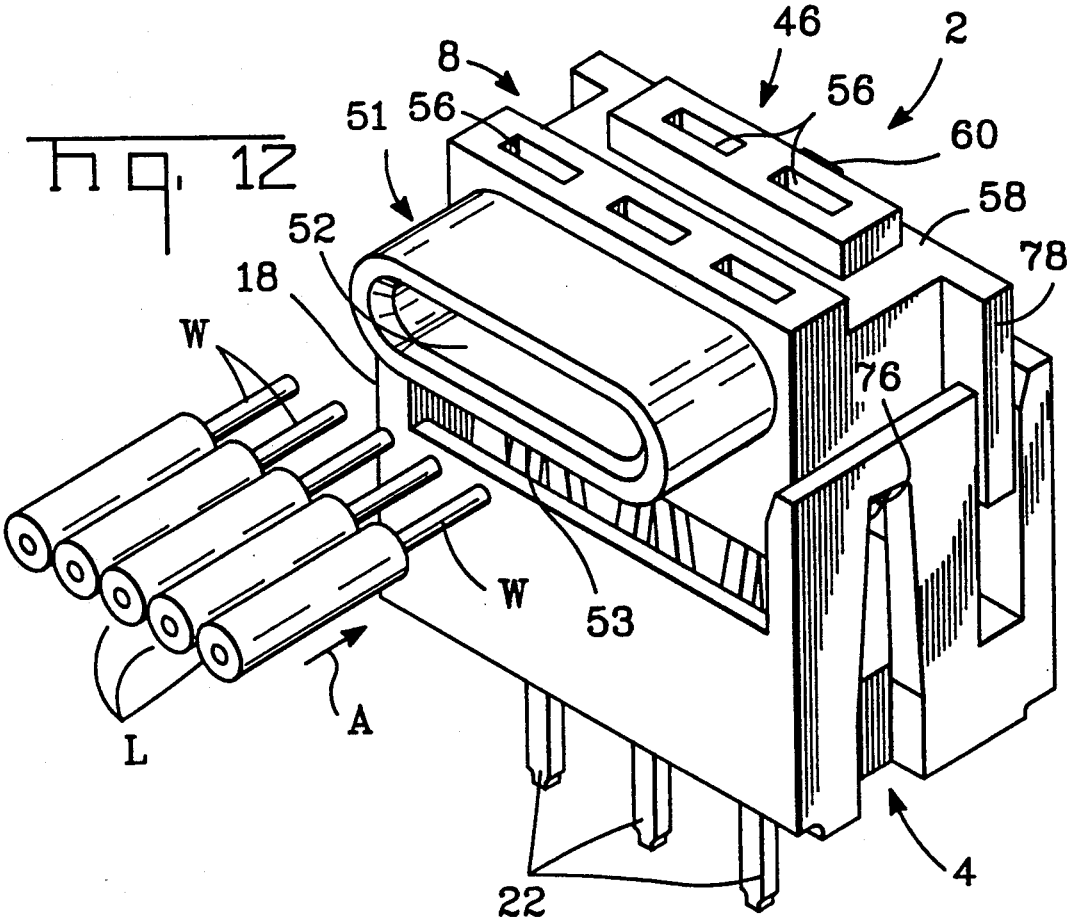
FIG. 12 is an isometric view of the connector showing the male housing partially mated with the female housing for the insertion of stripped end portions of the insulated electrical leads into the male housing.

As shown in FIG. 12, in the aforesaid initial position of the housing 8, the latch member 66 engages against the upper edge of the latch arm 17, each key 78 of the housing 8 engaging in a respective keyway 74 of the housing 4, each latch member 76 of the housing 8 engaging against the latching shoulder 72 of a respective side wall 18. The housing is stabilized in the housing 4 by the engagement of the keys 78 in the keyways 74. As the housing 8 is inserted into its initial position of the housing 4, the side walls 18 are spread resiliently part by the latch members 76 of the housing 8 and then resile as the latch members 76 pass the shoulders 72, whereby the housing 8 is captive in the housing 4. FIG. 13 shows the wires W when they have been inserted in the direction of the arrow A in FIGS. 1 and 12, into the wire receiving passages 48, with the insulation I of the leads L received in the hood 51. As shown in FIG. 13, in said initial position, each wire W lies just above the mouth 40 of a respective one of the terminal 6.

Figure 14:
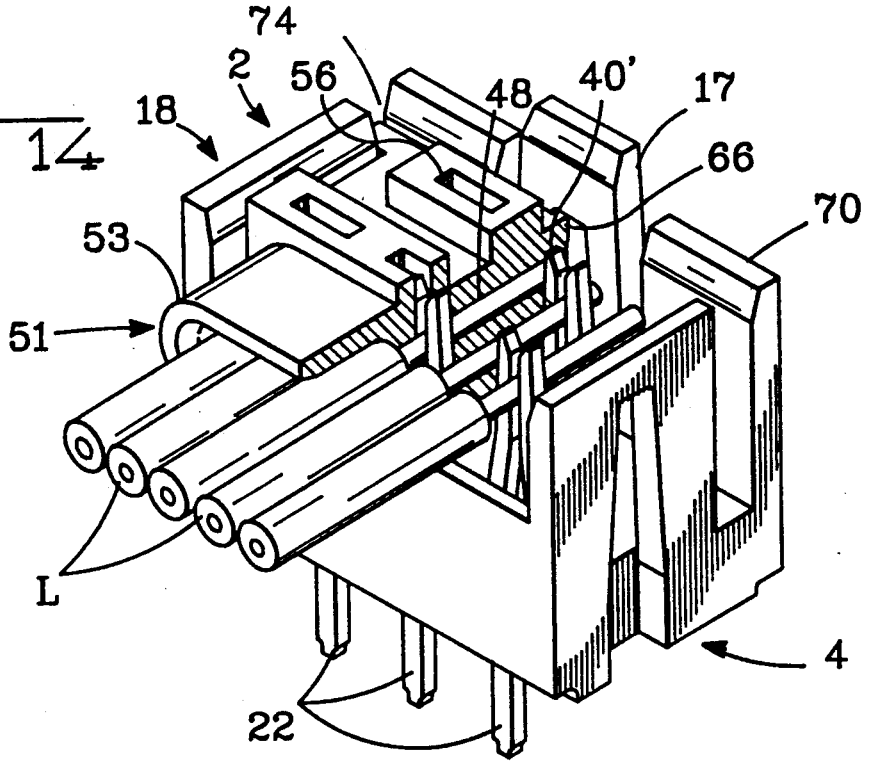
FIG. 14 is a similar view to that of FIG. 13 showing the male housing fully mated with the female housing.

FIG. 14 shows the connector 2 when the housing 8 has been fully depressed in the direction of the arrow B in FIG. 1, guided by the engagement of the keys 78 in the keyways 74, so that each wire W lies between the contact surfaces 37 of the respective terminal 6, the latch member 66 being engaged against the shoulder 19 of the latch arm 17.

Figure 15:
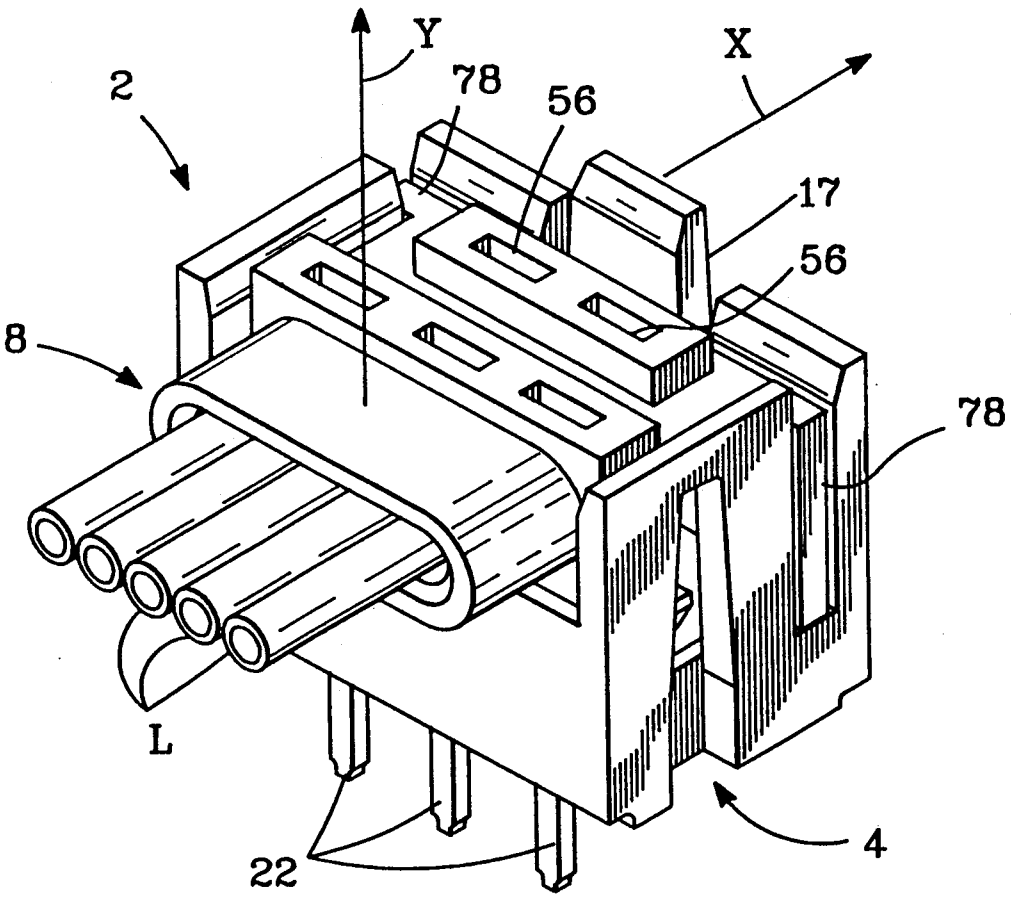
FIG. 15 is an isometric view showing the male housing fully mated with the female housing.

As indicated in FIG. 15, the housing 8 can be withdrawn from the housing 4 back to its initial position, by manually pulling back the latch arm 17 in the direction of the arrow X, while simultaneously withdrawing the housing 8 in the direction of the arrow Y, thereby disconnecting wires from the terminals 6. The connector 2 can accordingly act as a switch, aided by the soft spring characteristics of the arms 28 of the terminals 6. The connector 2, is, therefore, suitable for use in an apparatus, for example domestic television or video apparatus, in which circuits are required to be broken when the apparatus is serviced.

By virtue of the long insertion length of each wire W between the parts 36 of the arms 28, the wire engaging surfaces of these parts clean from the wire any intermatallics arising from the production of the wire, before the wire reaches the contact surfaces 37.

We claim:

1. An electrical connector, comprising:

a first insulating housing having a base through which extends a plurality of terminal receiving openings;

plurality of electrical terminals each having an anchoring portion received in a respective one of said openings, a connecting portion for connection to an external electrical conductor, and a pair of wire connecting arms upstanding from the base, the wire connecting arms of each terminal each having a lower part connected to the anchoring part of the terminal and a wire receiving upper part remote from the base and being substantially shorter than said lower part, the lower parts of the arms converging toward the upper part of the arms in a direction away from the anchoring portion of the terminal, and the upper parts of the arms being parallel to each other and having opposed parallel, wire contacting surfaces; and a second insulating housing for mating with the first insulating housing in a mating direction, the second insulating housing having means for supporting a plurality of wires extending transversely of the mating direction, for the engagement of each wire, between the wire contacting surfaces of the wire receiving upper part of a respective one of the terminals when the second insulating housing has been mated with the first insulating housing.

2. A connector as claimed in claim 1, wherein the upper part of each arm of each terminal is of substantially square cross section.

3. A connector as claimed in claim 1, wherein each terminal receiving opening is a through slot in the base of the first insulating housing, each terminal being uniplanar and the anchoring portion of the terminal being rectangular, a bight of the terminal material connecting lower ends of the lower parts of the arms of each terminal and a neck of the terminal material connecting the bight to an upper edge of the anchoring portion of the terminal, and the connecting portion of the terminal projecting from a lower edge of the anchoring portion and below the base of the first insulating housing.

4. A connector as claimed in claim 1, wherein the lower parts of the arms of each terminal have been pretorsioned about longitudinal axes thereof.

5. A connector as claimed in claim 1, wherein the first insulating housing has opposed walls projecting from the base to define a socket in cooperation therewith, the second insulating housing having a plug portion for reception in said socket, a part of one of the walls of the socket providing a latch arm projecting above said walls to serve as a handle, the second insulating housing having a first latch member for latching engagement with said latch arm when the plug portion is received in the socket, the handle being movable to unlatch the latch arm from the latch member so as to allow the plug portion to be removed from said socket.

6. A connector as claimed in claim 5, wherein said handle has an upper edge portion upon which said latch member can rest to support a second insulating housing with the plug portion partially withdrawn from the socket, and wires supported by the wire supporting means of the second insulating housing, located above the upper parts of the arms of the terminals.

7. Connector as claimed in claim 6, wherein further walls of said socket and second insulating housing, have means for restraining withdrawal of the plug portion from the socket when the latch member is resting on said upper surface of the latch arm.

8. An electrical connector comprising; a first insulating housing having a base from which upstand opposite side walls and opposite end walls cooperating with the base to define a socket, a plurality of terminal receiving openings extending through the base;

a plurality of electrical terminals each having an anchoring portion received in a respective one of said openings, a connecting portion depending from the base for connection to an electrical conductor and a pair of wire connecting arms upstanding from the base of the socket and extending into the socket, each pair of wire connecting arms defining a wire receiving slot opening in a direction away from the base; and a second insulating housing having a plug portion for insertion into the socket of the first insulating housing in a mating direction to mate the second insulating housing with the first insulating housing the second insulating housing having means for supporting a plurality of wires extending transversely of said mating direction, each for engagement in the wire receiving slot of a respective one of the terminals in the second insulating housing when the second insulating housing has been mated with the first insulating housing;

Wherein part of one side wall of the socket is formed as a first latch arm, the second housing having a first latch member for latching engagement with the latch arm, to latch the first and second insulating housings in mating relationship, the first latch arm having a handle portion projecting above said one said wall, for unlatching the first latch arm from the latch member to allow the plug to be withdrawn from the socket.

9. A connector as claimed in claim 8, wherein said end walls of the socket are constructed as second latch arms having latching shoulders, the first latch arm having an upper surface upon which the first latching member can rest with the plug portion partially withdrawn from the socket, so that wires supported by the wire supporting means of the second housing lie above the wire connecting arms of the terminals with the second latching members engaging respective ones of the latching shoulders, the side walls of the socket cooperating with the end walls thereof, to define keyways, and the second insulating housing have keys which are engagable with the keyways for guiding the first and second housings into their mated relationship.

10. An electrical connector as claimed in claim 8, wherein the plug portion of the second insulating housing is hollow and the second insulating housing comprises a wire receiving block surmounting the plug portion, the block having a wire receiving face and defining a row of wire receiving passages opening into the wire receiving face and a row of slots each for receiving the wire connecting arms of a respective one of the electrical terminals, each slot intersecting a respective one of said wire receiving passages and opening into the interior of the hollow plug portion.

11. A one piece stamped and formed electrical terminal comprising an anchoring portion for reception in an opening in an insulating housing, the anchoring portion having an upper and lower edge, a neck extending from the upper edge of the anchoring portion, a bight surmounting the anchoring portion and being convex theretowards, and having first and second upper ends, a first wire connecting arm upstanding from the first upper end of the bight and a second wire connecting arm upstanding from the second upper end of the bight, each arm having a lower part extending from the bight and being surmounted by an upper part remote from the bight, the lower parts of the arms converging towards one another in a direction away from the bight and towards the upper parts of the arms, the upper parts of the arms being parallel to one another and having opposed, flat, parallel wire contacting surfaces of shorter length than the lower parts of the arms, for resiliently engaging a wire inserted between said wire contacting surfaces.

12. A terminal as claimed in claim 11, wherein the lower parts of the arms are pre-torsioned about longitudinal axes thereof in opposite angular senses.

13. A terminal as claimed in claim 11, wherein the upper part of each arm is of substantially square cross section.

* * * * *